US005094096A

United States Patent [19]

Sheckells

[11] Patent Number: 5,094,096

[45] Date of Patent: Mar. 10, 1992

[54] METHOD OF BENDING

[75] Inventor: Amuel E. Sheckells, Senatobia, Miss.

[73] Assignee: Chromcraft Furniture Corp., Senatobia, Miss.

[21] Appl. No.: 366,678

[22] Filed: Jun. 14, 1989

[51] Int. Cl.[5] ..... B21D 7/04

[52] U.S. Cl. ..... 72/369; 72/152; 72/702

[58] Field of Search ..... 72/149, 152, 369, 701, 72/702; 29/157 A

[56] References Cited

U.S. PATENT DOCUMENTS

| | | | |
|---|---|---|---|
| 2,341,178 | 2/1944 | Duer | 72/149 |
| 2,500,813 | 3/1950 | Fritsch | 29/157 A |
| 2,957,229 | 10/1960 | Beatty | 29/157 R |
| 3,240,048 | 3/1966 | Callendar | 72/369 |
| 3,242,710 | 3/1966 | Hamlin | 72/156 |

FOREIGN PATENT DOCUMENTS

| | | | |
|---|---|---|---|
| 32831 | 2/1982 | Japan | 72/369 |
| 531600 | 10/1976 | U.S.S.R. | 72/369 |
| 795608 | 1/1981 | U.S.S.R. | 72/369 |
| 962937 | 7/1964 | United Kingdom | 72/369 |
| 624227 | 5/1979 | United Kingdom | 72/369 |

*Primary Examiner*—Robert L. Spruill
*Attorney, Agent, or Firm*—Wolf, Greenfield & Sacks

[57] ABSTRACT

A method of bending round tubular metal stock for use in the manufacture of tubular frame furniture comprising the steps of first bending the stock to a shape close to the final angle and thereafter compressing the stock in a direction perpendicular to the plane of the bend so as to fractionally increase the stock diameter in the plane of the bend and reversely bend the stock so as to achieve the final angular relation.

6 Claims, 3 Drawing Sheets

METHOD OF BENDING

INTRODUCTION

This invention relates to a method of bending metal stock and more particularly comprises an improved method of bending tubular metal stock used in the manufacture of cantilevered furniture.

Tubular frame furniture has for many years enjoyed great popularity, and it is manufactured in a very wide variety of chair and table designs. One class of tubular frame furniture is the cantilevered design which includes the so-called sleigh frame chair wherein a continuous length of tubing is formed with a pair of generally parallel sections that extend back to front and lie on the floor, vertical sections that extend upwardly from the front ends of the bottom sections and rise to the height of the seat, seat supporting sections that extend from the tops of the vertical sections rearwardly and generally parallel to the bottom sections, and back sections that support the back of the chair and extend upwardly from the rear ends of the seat supporting sections. The sections on each side of the chair are normally joined together either at the rear of the bottom sections or at the top of the back sections. It is well recognized in the industry that the weakest points in such cantilevered frames are at the bends which join the various sections together. In the cantilevered chair described above, the bends which receive the most stress and are therefore most susceptible to failure are those which join the bottom sections to the vertical sections, and the second most vulnerable bends are those which join the tops of the vertical sections to the seat supporting sections.

A variety of different machines are used to form the bends in the tubing, but in all known methods, the diameter of the tubing at the bends is diminished by the bending process, which weakens the tubular material at the bends and reduces the resistance to failure. An obvious way of dealing with the problem is to use heavier gage tubing, but that directly increases the cost of the furniture. A variety of other techniques have been employed to compensate for the reduced strength without increasing the gage of the tube. One frequently used method calls for the insertion of an inner reinforcing tube at the bends, but that adds several steps to the manufacturing process, significantly increases the manufacturing costs, is very difficult to accomplish and adds relatively little to the strength. Another method is to use oval stock and bend in the plane of the major diameter, but that is not acceptable when more than one geometric shape is desired, and the unbent portions of the frame may not be esthetically acceptable.

The principal object of the present invention is to provide a method for bending tubular metal stock, which not only eliminates the loss of strength normally incurred as a result of bending of the stock but greatly increases its strength.

Another important object of the present invention is to provide a technique for bending tubular metal stock, which may substantially or completely restore the original diameter of the tube in the plane of the bend or even increase that diameter after the tube is bent. That action gives the tube an enlarged section modulus in the plane of the bend, which in turn increases the tube strength in that plane.

Still another important object cf the present invention is to enable the manufacturer of tubular frames to use smaller gauge tubing in frame construction so as to significantly reduce manufacturing costs.

Yet another important object of the present invention is to eliminate the need for using reinforcing members at the bends in tubular metal stock.

To accomplish these and other objects, in accordance with one embodiment of the present invention, after the tubular stock is bent, the stock is subjected to compressive loads in a direction perpendicular to the plane cf the bend. This action fractionally increases the diameter of the stock in the plane of the bend. Thus, the reduction in diameter of the stock incurred by bending is partially or completely restored or even exceeded during the compression step. During the initial bending, the angle through which the stock is bent may exceed the final intended angle, and the compression load may affect reverse bending of the stock to achieve the ultimate desired angular relationship.

In accordance with another embodiment, the stock may be pre-stressed either as an additional step in the manufacturing method or in place of the compressive load reverse bending, by a load which exceeds the elastic limit of the stock to permanently set the stock. The ultimate desired angular relationship is achieved by taking into account not only the permanent set, but the spring back of the stock as well.

These and other objects and features of the present invention will be better understood and appreciated from the following detailed description of several embodiments thereof, read in connection with the accompanying drawings.

BRIEF FIGURE DESCRIPTION

DETAILED DESCRIPTION

Figure 1:
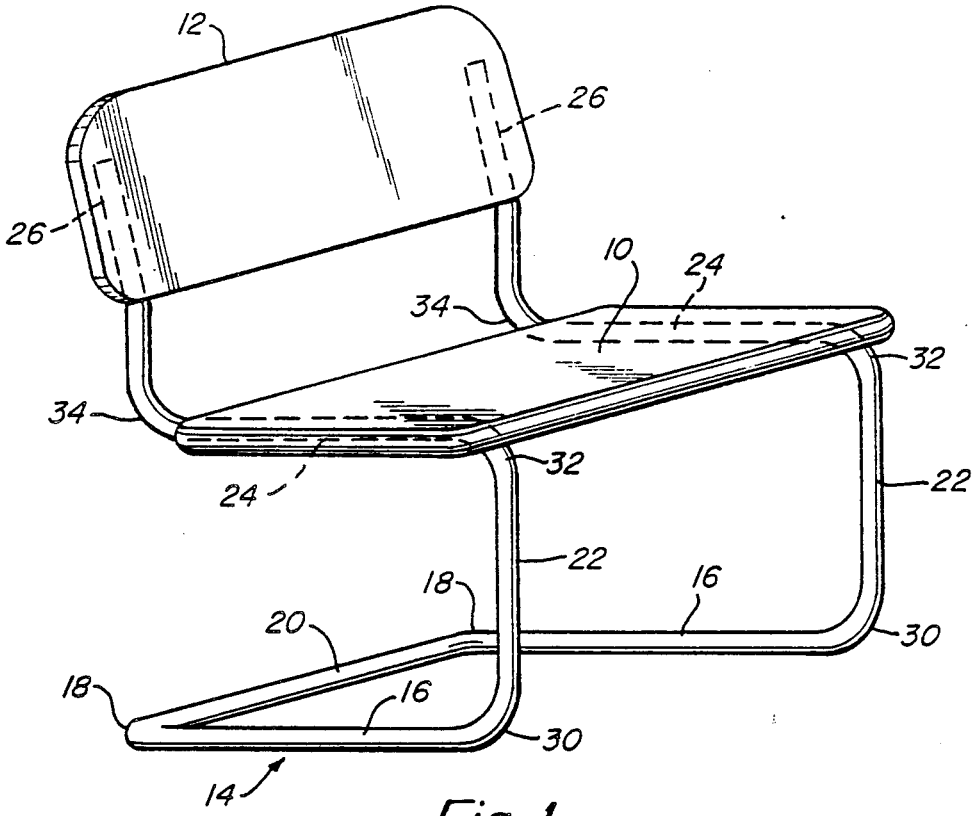
FIG. 1 is a perspective view of a typical chair having a tubular metal frame which may be made in accordance with the teachings of the present invention.

The chair shown in FIG. 1 is one example of many different types of cantilevered frame furniture that may greatly benefit from the present invention. The chair shown includes a seat 10 and backrest 12 which are fastened to and supported by the tubular metal frame 14.

The frame 14 includes bottom sections 16 which are connected at their rear ends 18 by connecting section 20, vertical sections 22 that extend upwardly from the fronts of the bottom sections 16, seat support sections 24 connected to the tops of the vertical sections 22, and back support sections 26 that are connected to the rear ends of the seat supporting sections 24. It will be apparent that in certain designs the two portions of the frame that lie along opposite sides of the chair may be connected by a tubular section joining the tops of the back support sections 26 rather than by the section 20 illustrated.

It is well recognized in the industry that the bends 30 which join the bottom sections 16 and vertical sections 22, bends 32 which join the tops of the vertical sections 22 to the seat support sections 24, and bends 34 that join the seat support sections 24 to the back support sections 26 are the points of the frame which are subjected to maximum stress, and in conventionally constructed chairs, those bends are the weakest portions of the frame. For both structural and esthetic reasons, the bends 30, 32, and 34 normally have a uniform radius and tangentially join the straight sections of the frame.

In accordance with one embodiment of the present invention, the furniture frame or other stock is first bent through an angle which exceeds the desired final angle bend for the stock, and thereafter it is subjected to reverse bending so as to increase the geometry of the stock at the bend and create the ultimate final desired angle of bend in it. In accordance with the present invention, the reverse bending is achieved by applying a load to the stock, in a direction generally perpendicular to the bend. That action increases the diameter of the stock measured in the plane of the bend and also alters the angle created by the initial bending step. The stock essentially unbends to a degree by this action, and the desired end configuration is achieved in that manner. This concept is described in greater detail in connection with FIGS. 3–8.

Figure 2:
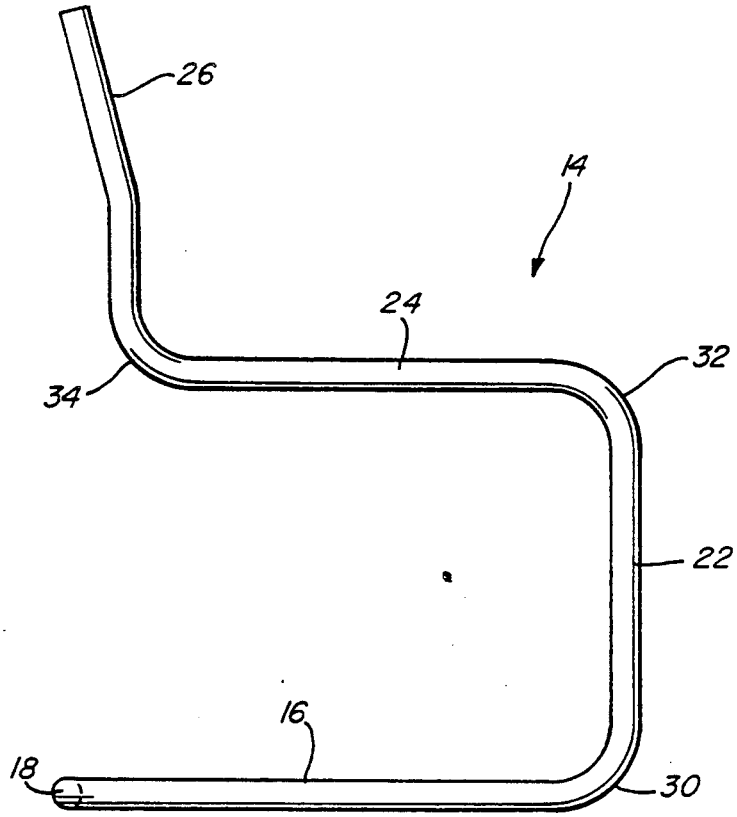
FIG. 2 is a side elevation view of the metal frame employed in the chair shown in FIG. 1.
Figure 3:
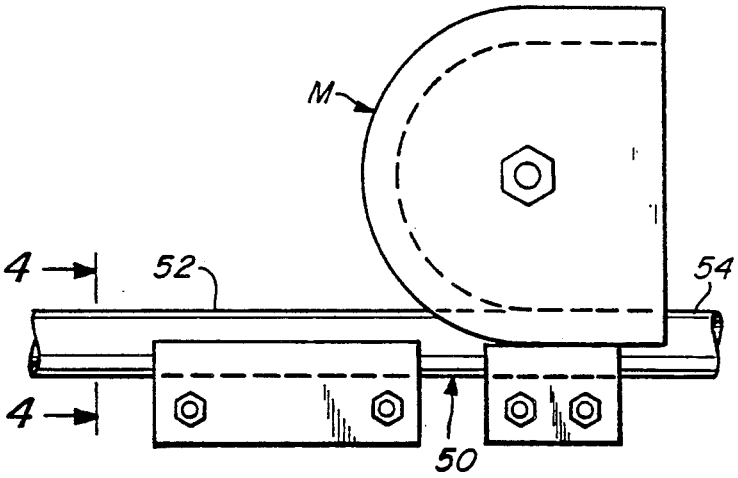
FIG. 3 is a side view of a length of round tubular metal stock before it is formed to its desired end shape and suggesting a tube bending machine which may be used to bend the stock around a radius.
Figure 4:
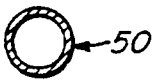
FIG. 4 is a cross-section of the tube of FIG. 3 taken along section line 4—4 thereof.

In FIG. 3 round, tubular metal stock 50 is shown which may be made of steel or other material and in this example, is of the type that may be used to form the frame 14 of FIG. 2 and used in the chair shown in FIG. 1. In the furniture industry, an example of such tubular stock is 14 gauge steel having an outer diameter of one inch and a wall thickness of 0.075" before it is bent into the desired shape. For purposes of illustration, it is to be assumed that the normal tubular steel stock 50 is to be bent about a radius of 2.5", and the final desired angle of bend is to be 90°. That is, the two ends 52 and 54 of the tubular stock beyond the radius are to be disposed at right angles to on another. As a first step in carrying out the method in accordance with one embodiment of this invention, the tubular stock 50 is bent as suggested in FIG. 5 by the tube bending machine M through an angle A in excess of 90°. It will be noted that a substantial portion of the circumference of tubular stock 50 is non-confined in the region where the stock is bent by the tube bending machine M. It will be noted in FIGS. 5 and 6 that the diameter of the stock in the plane of the bend is fractionally reduced as compared to the diameter of FIG. 4. The stock now has an elliptical cross-section with a major diameter B greater than 1 inch and a minor diameter C which is something less than 1 inch.

Figure 5:
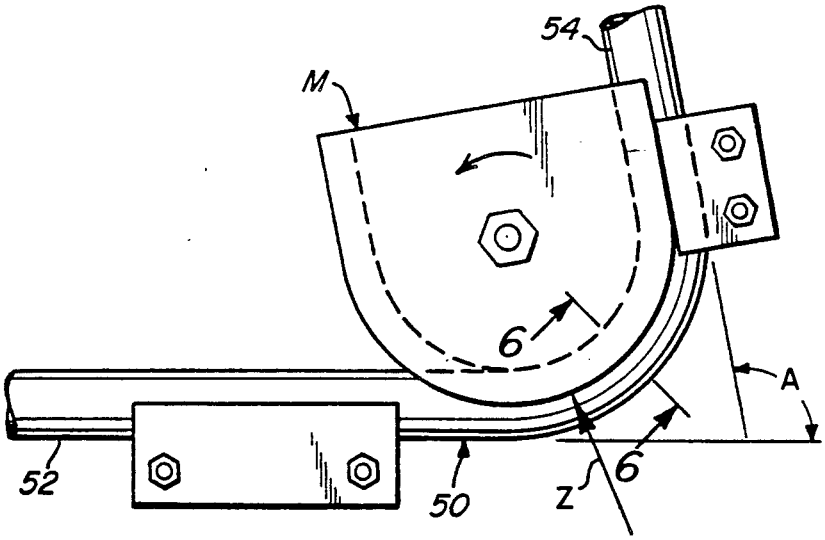
FIG. 5 is a side view of the stock and machine shown in FIG. 3 after initial bending, but before the forces are applied to accomplish the reverse bending technique of the present invention.
Figure 6:
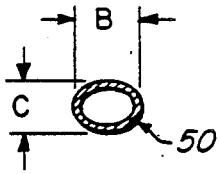
FIG. 6 is a cross sectional view of the tube of FIG. 5 taken along the section line 6—6 thereof.
Figure 7:
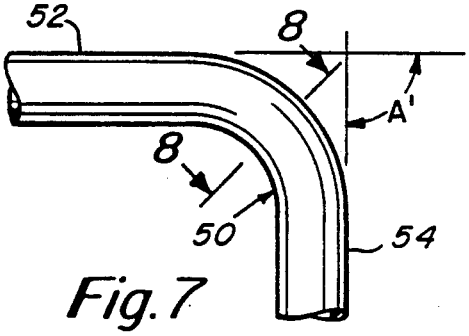
FIG. 7 is a side view of the tube shown in FIGS. 3–6 after the compressive force has been applied to the tubular stock so as to reverse bend it.
Figure 8:
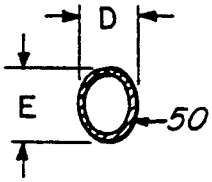
FIG. 8 is a cross-sectional view of the tubular stock shown in FIG. 7 taken along section line 8—8 thereof.

After the initial bending step is completed, the bent stock 50 is subjected to a compressive load in a direction essentially perpendicular to the plane of the bend (the plane of paper) as suggested in FIG. 5 by arrow Z. The compressive load applied to the tube in the region of the bend in that direction will cause the cross-sectional geometry of the tube at the bend to change as suggested in FIG. 8. In that figure, which represents the configuration of the tube after the compressive load is applied, the major diameter D of the tube will be less than diameter B while the minor diameter E of the tube will be greater than minor diameter C. Diameter E may be slightly less than, equal to or slightly exceed the original 1" diameter of the tube. At the same time, the angle A will be reduced by the number of degrees in excess of the ultimate angular relationship of the two arms. The angular relationship between the arms is brought to 90° as shown in FIG. 7 at A', which is the stated desired end relationship. Thus the compressive load applied to the stock perpendicular to the plane of the angle results in reverse bending to achieve the desired final angular relationship on each side of the bend and also very substantially increases the strength of the stock at the bend to oppose the forces applied at the bend by flexing of the frame.

Reverse bending in the manner described above has many advantages. For example, reverse bending of the stock after initial forming does not reduce or stretch the tubing as would occur if the compressive loads were applied to alter the geometry in anticipation of the changes which occur during bending. In addition, increasing the geometry after bending increases the strength of the stock at the bend while that action before bending will result in a reduction in the stock strength. As yet another advantage, reverse bending after initial bending to near the final shape can be carried out with virtually all shapes whereas the same is not true of reverse bending in anticipation of the final bend because failures sometime occur as a result of over stretching. As yet another advantage, the present invention allows essentially infinite and minute dimensional variations which can be carried out in a very short time by a single operator on an individual basis. Furthermore, when more than one geometric shape is desired in a given product, reverse bending may be applied to the particular portion of the product for each desired shape, but that is not possible when an attempt is made to reverse bend after the initial forming stage of the tubular stock and before major bending.

The foregoing description defines a first embodiment of the present invention in which the stock is subjected to reverse bending by the application of compressive loads in a direction perpendicular to the plane of the bend to open the bend a few degrees so as to establish the ultimate pre-selected angular bend in the stock. In accordance with other embodiments of this invention, the reverse bending of the stock is coupled with pre-stressing, which may enhance not only the strength of the stock at the bend, but along the straight sections of the stock as well. Several methods of manufacturing a tubular metal frame with pre-stressing are hereinafter described in connection with FIGS. 9 and 10.

Figure 9:
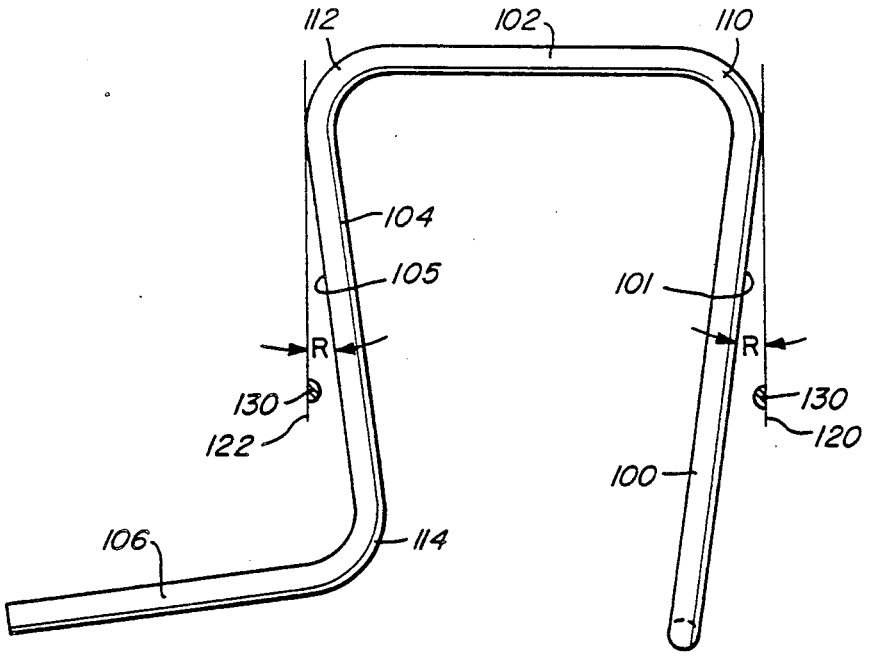
FIG. 9 is a diagrammatical view of a chair frame suggesting the step of pre-stressing in the manufacturing process.

In FIG. 9 an S-shaped, cantilevered, tubular metal frame is shown having a bottom section 100, a front vertical section 102, a seat support section 104 and a back support section 106. These sections are joined by a lower front bend 110, upper front bend 112 and upper rear bend 114. The full line showing in that figure represents the positions of the various sections of the frame after it has been initially bent to near its final configuration, but not subjected either to reverse bending or pre-stressing, which follow in the method. The lines 120 and 122 represent the planes of the bottom surface 10 of the bottom section 100 and the top surface 105 of the seat support section 104 when the frame is in its final desired shape. Those planes are parallel to one another.

It is evident that during the initial forming of the chair, the bottom and seat support sections 100 and 104, respectively, have each been bent beyond the ultimate target positions by an angle R. After the frame has been bent to the full line position of FIG. 9, in accordance with one method of this invention compressive loads are applied to the frame in the plane perpendicular to the planes of bends 110 and 112 which cause the bottom and seat support sections 100 and 102 to move away from one another as described above in connection with the first embodiment. However, in order to pre-stress the frame, the movement of the bottom and seat support sections away from one another is limited by the stops represented diagrammatically at 130. The stops interrupt the spread of the two sections of the frame before they reach the final intended positions represented by the lines 120 and 122 in the drawings. When the stops are thereafter removed, the spring action of the structural material will cause the frame to open to its ultimate or final desired position. In accordance with the foregoing pre-stressing method, the reverse bending and prestressing are combined as a single step to add strength to the frame by the application of a calculated load exceeding the elastic limits of the stock. The calculations also reflect the angle through which the frame is initially bent.

Figure 10:
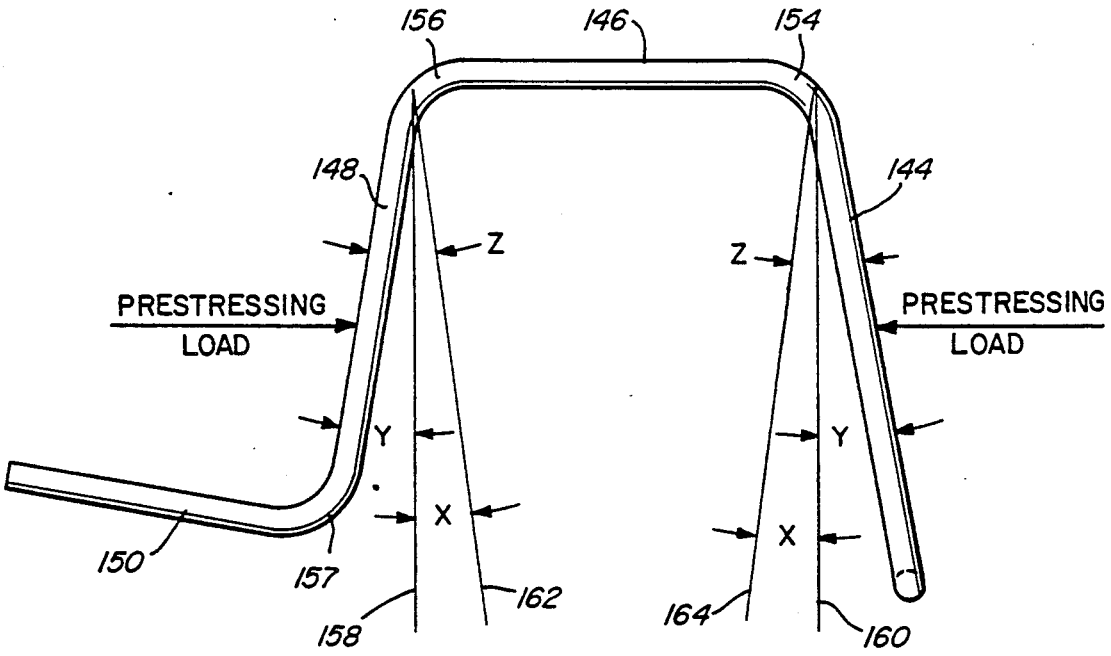
FIG. 10 is a view similar to FIG. 9 and suggesting another method of this invention employing prestressing.

Another embodiment of this invention employing prestressing is described below in connection with FIG. 10. It is well known in the industry that when a chair of the cantilevered type is loaded beyond its elastic limit, a permanent set is realized and the frame floor and seat sections will no longer be parallel and the frame would be permanently defective (bent beyond acceptable limit). Prestressing addresses this condition as shown in FIG. 10 by adding a prestressing load applied in a magnitude and direction similar to the excessive load described above, which caused permanent set, with one exception. Prestressing, in accordance with this invention, will allow the chair to carry the load above without permanent set. In fact, the chair will be capable of withstanding a load up to the prestressing load to be described below or to the ultimate strength of the metal frame and will not take an additional permanent set.

The frame shown in FIG. 10 has been initially formed and reverse bent as previously described in connection with FIGS. 3–8 and is ready for prestressing. It includes bottom section 144, front section 146, seat support section 148, back support section 150 and bends 154, 156 and 157. In FIG. 10 the floor or bottom section 144 and the seat support section 148 are shown to be biased open from the final desired position by the angle "Y". A calculated prestressing load at or near the ultimate strength of the material is applied to frame sections 144 and 148 so as to force them through angles "Y" and to predetermined angles Z to the position of lines 162 and 164. When the prestressing load is removed, the seat and floor sections 144 and 148 spring back through angle X to their final intended position 160 and 158 so as to be parallel with each other. It should be appreciated that no permanent set in the prestressed chair frame will thereafter occur unless the prestressing applied load has been exceeded.

The permanent set through angle "Y" is predetermined to make the chair conform to its final intended position in the design stage thus allowing the product to greatly increase its capacity without taking on undesirable permanent set similar to angle "X" if prestressing had not been preformed on the product.

From the various embodiments described above, those skilled in the art will appreciate that numerous modifications may be made thereof without departing from the spirit of this invention. Therefore, it is not intended that the scope of this invention be limited to the specific embodiments illustrated and described. Rather, the scope is to be determined by the appended claims and their equivalents.

I claim:

1. A method of enhancing the strength of bends in a tubular metal frame member used in cantilevered furniture products comprising the steps of first bending the tubular metal frame member so that it approximates the ultimate desired shape of the member, and thereafter applying a compressive force against the frame member at the bend in a direction generally perpendicular to the plane of the bend causing the thickness of the tubular member at the bend to increase in the plane of the bend, the first bending of the member includes imparting a bend beyond the ultimate desired shape of the member, and the compression force reduces the bend to the ultimate desired shape.

2. A method of enhancing the strength of a structural member which in its final form is to be bent about a radius to a final selected angle comprising the steps of first bending the member about a radius through an angle greater than the final selected angle, next applying a compressive force to the member at the bend to increase the thickness dimension of the member at the bend measured in the plane of the bend sufficient to cause the bend to open to a smaller angle than the final selected angle, thereafter applying a load to the member which exceeds the elastic limit of the member to bend the radius so that the angle again exceeds the final selected angle, and finally allowing the elastic memory of the member to unbend the member causing it to assume the final selected angle.

3. A method as defined in claim 2 wherein the structural member is a tubular member.

4. A method as defined in claim 3 wherein the structural member is made of metal.

5. A method as defined in claim 4 wherein the metal tubular member is a cantilevered furniture frame.

6. A method of enhancing the strength of a structural member which in its final form is to be bent about a radius to a final selected angle comprising the steps of first bending the member about a radius through a angle greater than the final selected angle, next applying a compressive force to the member at the bend to increase the thickness dimension of the member at the bend measured in the plane of the bend sufficient to cause the bend to open to a smaller angle than the final selected angle, applying a reactive force to the member in the plane of bend to prevent the bend from opening fully under the influence of the compressive force, and thereafter removing both the compressive force and the reactive force so as to allow the member to bend under the elastic memory of the material to the desired final selected angle.

* * * * *